United States Patent [19]

Peters

[11] 3,961,455

[45] June 8, 1976

[54] TRUSS SUPPORT CONNECTOR

[76] Inventor: Dierk D. Peters, 5815 Highland, Yorba Linda, Calif. 92686

[22] Filed: Oct. 21, 1974

[21] Appl. No.: 516,281

Related U.S. Application Data

[63] Continuation of Ser. No. 365,033, May 29, 1973, abandoned.

[52] U.S. Cl. ..... 52/693; 52/751

[51] Int. Cl.[2] ..... E04C 3/02

[58] Field of Search ..... 52/691–695, 52/639, 642, 291, 225, 751

[56] References Cited

UNITED STATES PATENTS

| | | | |
|---|---|---|---|
| 1,737,601 | 12/1929 | Macomber | 52/691 X |
| 2,770,846 | 11/1956 | Findleton | 52/642 |
| 3,527,007 | 9/1970 | McManus | 52/692 X |
| 3,570,204 | 3/1971 | Birkemier | 52/693 X |
| 3,651,612 | 3/1972 | Schmitt | 52/693 |

*Primary Examiner*—Ernest R. Purser
*Assistant Examiner*—Carl D. Friedman
*Attorney, Agent, or Firm*—Knobbe, Martens, Olson, Hubbard & Bear

[57] ABSTRACT

A truss support connector for attaching a truss joist to a supporting wall or horizontal member in the construction of buildings and various structures. The truss joist includes a top chord and a bottom chord which are connected by series of horizontally spaced diagonal web members. The truss support connector comprises an angle member connected to a strengthening member. The angle member is used to connect the truss joist to the supporting wall at the longitudinal ends of the top or bottom chord while the strengthening member is located in a vertical slot in the longitudinal ends of the top or bottom chord and extends from the angle member along the chord, receiving two of the ends of the spaced web members adjacent the support or supporting wall. The strengthening member additionally provides a web plate or series of web plates for connecting the web members to the chords.

24 Claims, 13 Drawing Figures

FIG. 11.
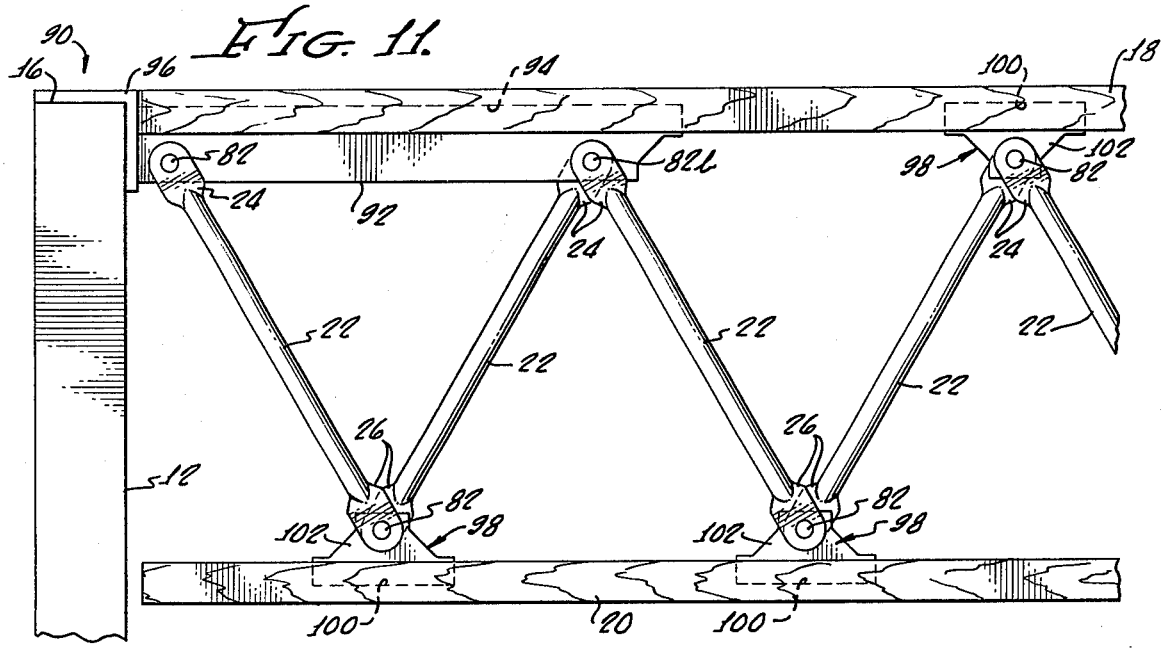
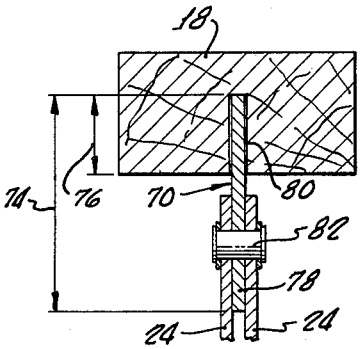
FIG. 10.
FIG. 12.
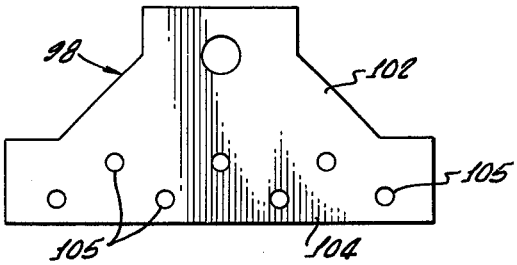
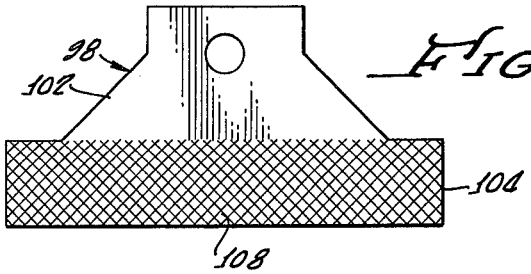
FIG. 13.

TRUSS SUPPORT CONNECTOR

This is a continuation of application Ser. No. 365,033, filed May 29, 1973, now abandoned.

BACKGROUND OF THE INVENTION

This invention relates to the field of truss joists typically constructed with wood top and bottom chords, connected by a series of diagonal horizontally spaced metal web members. These truss joists are used in the construction of buildings to provide support for the placement of floors or roofs. The invention specifically relates to the connection of the truss joist to the supporting walls or horizontal members.

In the construction of homes and buildings of various types and sizes, there is a need and demand for support members constructed of relatively lightweight material to support fairly large loads. The construction of various truss joist configurations fulfills this need through the use of relatively light wood chord members connected by the use of small structural web members typically fabricated of some type of metallic material.

A problem area of continued concern has been the means by which the ends of the truss joist are connected to the supporting walls or horizontal members, since the chord members of the truss joist are typically wood and the strength of these chord members is not sufficient to withstand the considerable shear and moment forces which result from various loads placed upon the truss member. To partially solve this problem prior art devices have placed the ends of the top chord member of the truss joist on the top surface of the support with the first pin connection to the first web member located directly above the top surface of the supporting wall. The placement of the pin connection to this first web member directly above the wall support and the connection of the wood chord member to this supporting wall alleviates the problem of shear and moment forces in wood because the shear forces are transmitted from the web member to the metal support connection and then to the top surface of the supporting wall.

However, as a result of placing the top chord member directly on the support surface with the pin connection directly above the support surface it is often necessary to place a notch or groove in the upper area of the support to accommodate the web member which angles up toward the pin connection from the bottom chord member to a point above the support surface located on top of the support. Placing a notch in the supporting wall for each truss joist is very time consuming and expensive in the construction of the building. An additional problem caused by the placement of the top chord member directly above the support surface is apparent in the construction of a floor or roof where there is the need to place filler blocks between the top chord members of adjacent truss joists along the upper surface of the support in order to fill in the gaps produced by the adjacent chord members.

Some prior art has attempted to alleviate this notch problem resulting from the differential between the planes of the upper surface of the chord member and the upper surface of the supporting wall by the utilization of a bracket on the end of the top chord member. The use of this bracket allows the first pin connection to be placed in spaced relation from the supporting wall, so that the requirement of placing a notch in the supporting wall or beam for the web member is eliminated. However, the actual differential between the planes remains along with the requirement for filler blocks, because the top chord is still placed above the supporting wall. It has been determined that, if the top chord is attached in some manner to the supporting wall so that the upper surfaces of the chord and the supporting wall are in the same plane, significant shear forces exist in the area of the chord adjacent the supporting wall and the first pin connections while significant moment forces exist between the first and second pin connections to a web member. The shear and bending moment diagrams for a typical truss joist are disclosed herein, reflecting the significant shear and moment forces, and the typical wood chord does not have the strength to withstand these forces. Consequently, the prior art has not been satisfactory in the practical solution of the problem, because the wood chord members do not have adequate strength to withstand the existing shear and bending moment forces when the truss joist is connected to the supporting wall in such a manner that the upper surface of the supporting wall is in the same horizontal plane as the upper surface of the chord member.

In prior art truss joist configurations the connection between the web members and the chord members requires the making of a vertical open channel within each of the chord members for receipt of the ends of the web members in order that, when the end of the web member is placed in the channel, a horizontal pin passing through the chord member will connect the web member to the chord. The introduction of a vertical open channel or groove into the chord member with a horizontal pin hole through the chord member at each web connection may have the disadvantage of weakening the chord member.

BRIEF SUMMARY OF THE INVENTION

The truss support connector includes an angle member connected to a strengthening member for connection with a truss joist chord member and a support or supporting wall. The angle member is attached to the support surface of the support while the strengthening member extends adjacent the chord member of the truss joint and connects with two of the web members adjacent the supporting wall.

The configuration of the truss support connector permits the connection of the truss with the support to result in the top surface of the top chord being in the same horizontal plane as the support surface of the support. Since the pin connections of the web members to the chord member are horizontally spaced from the supporting wall, the necessity of notches in the upper portion of the supporting wall to accommodate the chord members is eliminated. Also the requirement of filler blocks between chord members is avoided. One embodiment of the strengthening member of the present invention includes the provision of a small and narrow open vertical channel in the chord member and a strengthening member bonded with the appropriate adhesive means within the open channel, leaving a portion of the strengthening member exposed either below or above the chord member. The exposed portion of the strengthening member is used for a connection to the web members. The bonding of the strengthening member within the open channel to the chord member does not introduce a weakening in the chord structure because of the elimination of the open channel or groove within the chord member for receipt of the web members.

The truss support connector with the strengthening member attached to the chord of the truss joist provides the necessary strength to the chord in order that it may resist the significant shear and moment forces which are characteristically found in the areas adjacent the first and second pin connections with the respective web members. Since the basic design of a typical truss joist with horizontally spaced diagonal web members provides enough strength to withstand the shear and bending moment forces beyond the second pin connection, the primary area of concern is adjacent the first and second pin connections. The purpose of the truss configuration is to transmit the shear and bending forces into purely tensile and compressive stresses within the chord members which typical wood chord members can withstand. Therefore, the remaining problem of shear and bending forces found adjacent the first and second pin connections is alleviated by the use of the extended strengthening member beyond the second pin connection to provide the needed strength within the wood chord members.

BRIEF DESCRIPTION OF DRAWINGS

FIG. 10 is a cross section taken along the lines 10—10 in FIG. 9 showing the strengthening member adhesively attached to the cord member;

FIG. 11 is an elevation view of an additional embodiment of the truss support connector with the top chord member used in conjunction with separated web plates attached to the chord members to provide anchor connections for the web members;

FIG. 12 is a side view of the strengthening member or web plate of FIG. 11 utilizing a series of perforations to promote better adhesion of the web plate within the chord member; and FIG. 13 is an alternative configuration of the strengthening member or web plate of FIG. 11 showing a hatched or etched surface to promote better adhesion within the chord member.

DETAILED DESCRIPTION OF INVENTION

Figure 1:
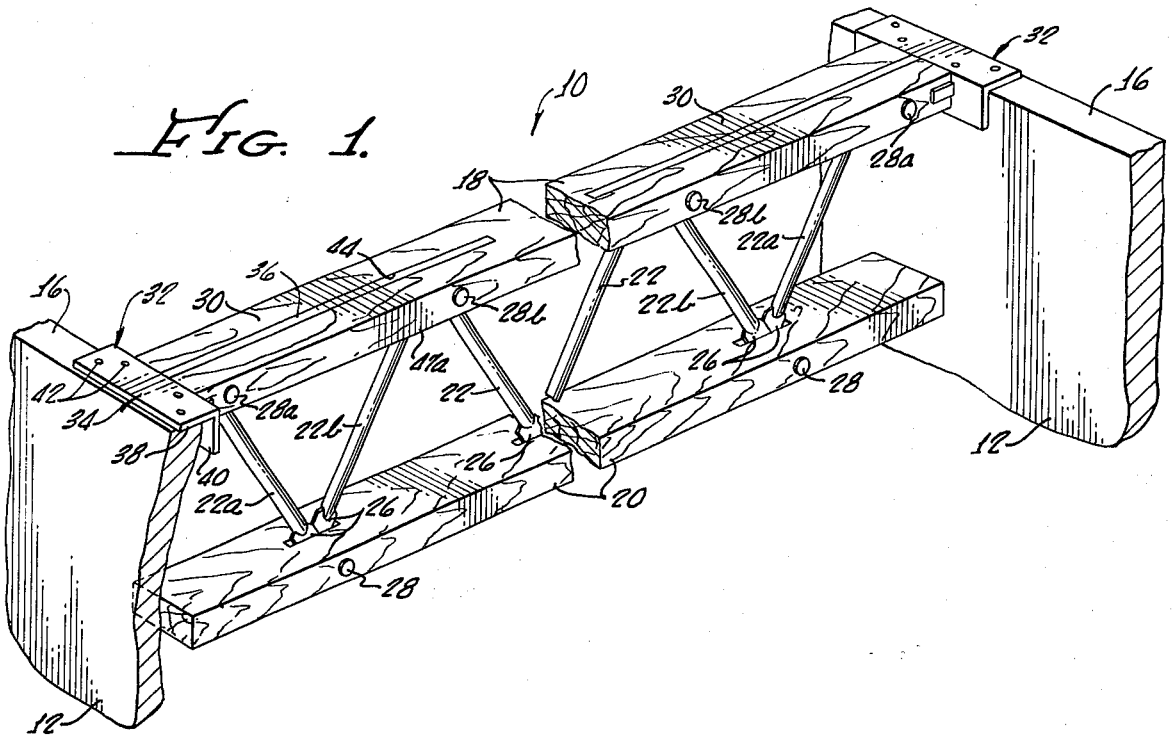
FIG. 1 is a perspective view of a typical truss joist extended between two supports.

FIG. 1 shows a typical truss joist arrangement 10 which is connected between two supports or supporting walls 12 having a top surface 16. The truss joist 10 is comprised of a top chord member 18 and a bottom chord member 20 which are connected by a series of horizontally spaced diagonal web members 22, having an upper end 24 and a lower end 26. The upper ends 24 and lower ends 26 of the web members 22 are respectively connected to the top chord member 18 and the bottom chord member 20 by pin connections 28. The upper surface 30 of the top chord member 18 is utilized as a support for a floor or a roof depending upon the structure which is being erected.

Figure 5:
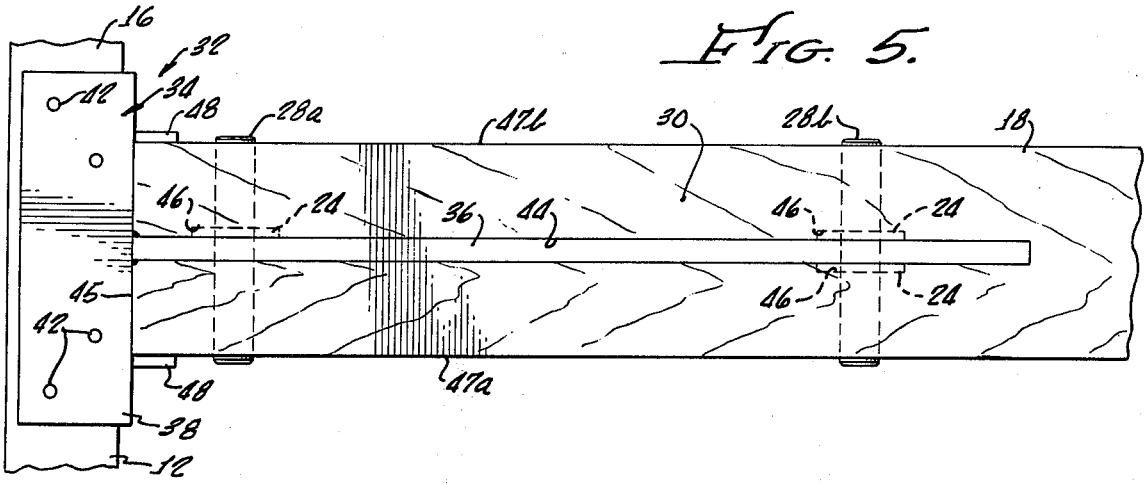
FIG. 5 is a top view of the preferred truss support connector as reflected in FIG. 2.
Figure 2:
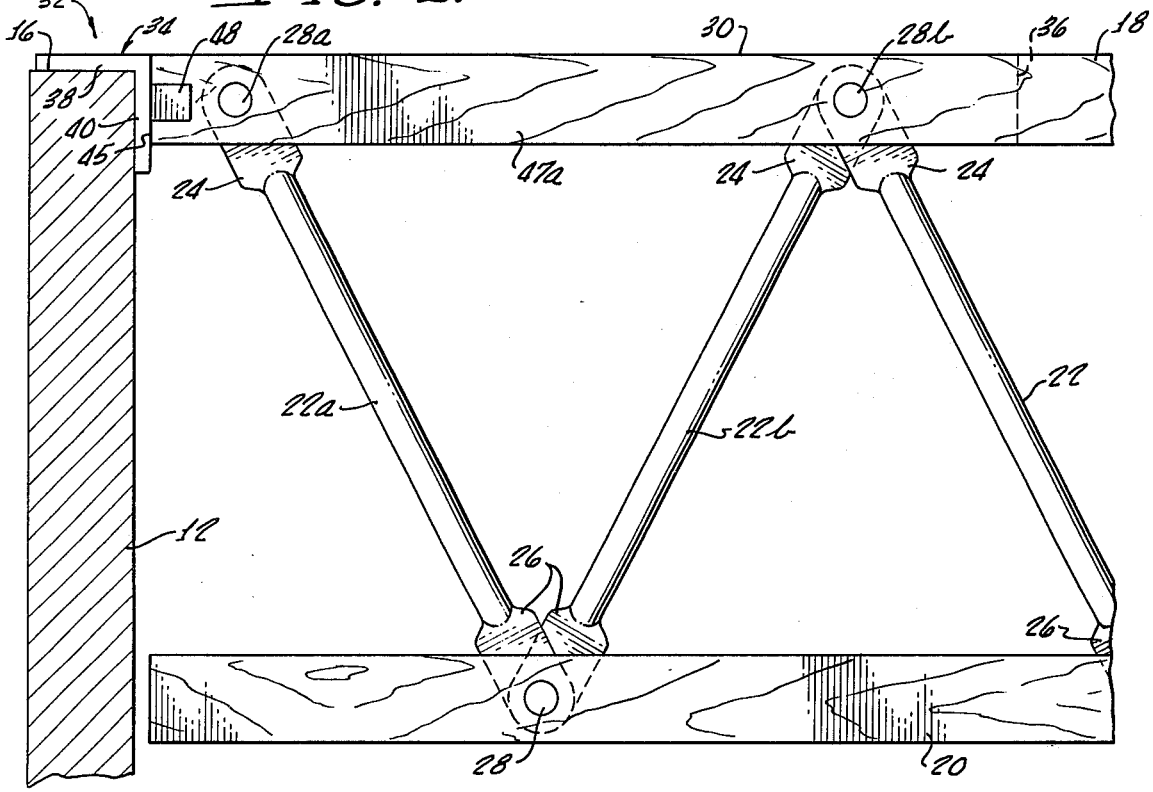
FIG. 2 is an elevation view of the truss joist connected to one of the supports, showing the preferred embodiment of the truss support connector included in the top chord of the truss joist.

Attached to each end of the top chord member 18 is the truss support connector 32 which is shown in more detail in FIGS. 2 and 5. The preferred embodiment of the 38 support connector 32 comprises an angle member 34 and a vertical plate or strengthening member 36. The angle member or L-shaped member 34 has a horizontal leg 38 and a vertical leg 40. The horizontal leg 38 is utilized to attach (i.e. either position or secure) the angle member 34 to the top surface 16 of the support 12. Located in the horizontal leg 34 are a series of apertures 42 for receipt of nails or other well known attaching means to secure the angle member 34 to the support 12 if desired. The top chord member 18 has a vertical longitudinal slot 44 at each of its longitudinal ends. The slot 44 extends from the end 45 of the top chord member to a point beyond the intersection of the upper end 24 of the second web member **22*b* with the chord member 18. Attached to the vertical leg 40 of the angle member 34 is a strengthening member 36 which is positioned within the slot 44. The strengthening member 36 is attached to the top chord member 18 by the insertion of two pins 28*a* and 28*b*, passing through the chord member 18 and the strengthening member 36. Located adjacent the pins 28*a* and 28*b* are recesses 46 cut into the slot 44 to receive the upper ends 24 of the web members 22*a* and 22*b* which are connected to the top chord member 18 and to the strengthening member 36 by the pins 28*a* and 28*b* respectively. Extending out from the vertical leg 40 of the angle member 34 are a pair of restraining tabs 48 positioned along the vertical surfaces 47*a* and 47*b* of the top chord member 18 in order to prevent lateral movement of the chord member 18 with respect to the angle member 34.**

Because the horizontal leg 38 of the angle member 34 rests on the top surface 16 of the supporting wall 12 as shown in FIG. 1, the upper surface 30 of the top chord member 18 is in the same horizontal plane as the top surface 16 of the supporting walls 12. This permits the direct attachment of a floor or ceiling sheet (not shown in the Figures) over both the top chord 18 and the supporting walls 12 to provide additional strength to the overall structural arrangement. By way of contrast, prior truss structures typically utilized a series of filler blocks between the supporting wall and the floor or ceiling sheet because the top chord was in a plane above the supporting wall. This prior use of filler blocks inherently reduced the ability of such sheets to transfer shear forces from the truss structure to the supporting wall. The unique strengthening member 36 of this invention permits the arrangement shown in FIG. 1, and this resulting feature of a common horizontal plane along the upper surfaces 30 and 16 of both the respective top chord member 18 and the supporting walls 12 for attachment of a floor or ceiling sheet without the use of filler blocks.

Figure 3:
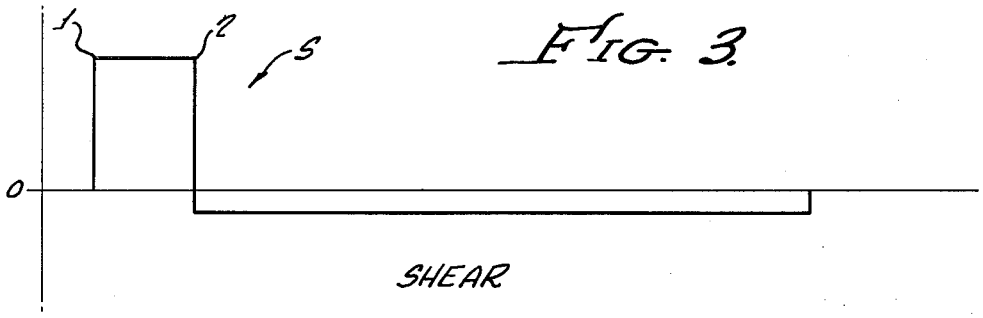
FIG. 3 is a shear diagram reflecting the relative shear forces associated along the strengthening member from the support to the second pin connection.

When the truss 10 is under a normal load, the relative shear forces S which develop along the top chord 18 adjacent a support are reflected in FIG. 3. These forces are characteristically found when the truss 10 is attached to the support 12 in the manner shown in FIG. 2 with the upper surface 30 of the chord member 18 in the same horizontal plane as the support surface 16 of the support 12 and with the first pin connection 28*a* horizontally spaced from the support 12. The shear S forces are the most significant between the support 12 and the first pin connection 28*a* or between points 1 and 2 on FIG. 3. Since the normal construction of a truss 10 utilizes wood chord members 18 and 20, the wood is typically unable to resist possible large shearing forces S. Therefore, the placement of the strengthening member 36 adjacent the ends of the chord member 18 provides the necessary additional strength required between the support 12 and the pin connection 28*a*.

Figure 4:
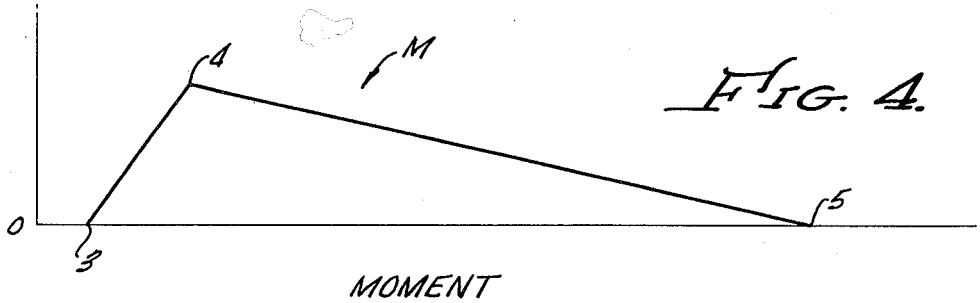
FIG. 4 is a moment diagram reflecting the relative magnitude of the bending moment forces associated with the strengthening member of the truss joist from a support to the second pin connection.

Also incident to the loading placed on the truss 10 connected to the support 12 as shown in FIG. 2 are the relative bending moment forces M shown in FIG. 4. There are significant bending moment forces not only between the support 12 and the first pin connection 28*a* (between points 3 and 4 on FIG. 4), but also between the first pin connection 28*a* and the second pin connection 28*b* (between points 4 and 5 on FIG. 4). Consequently, the strengthening member 36 must extend beyond the second pin connection 28*b* to provide the necessary additional strength to resist possible detrimental bending forces M to the wood chord member 18.

Figure 6:
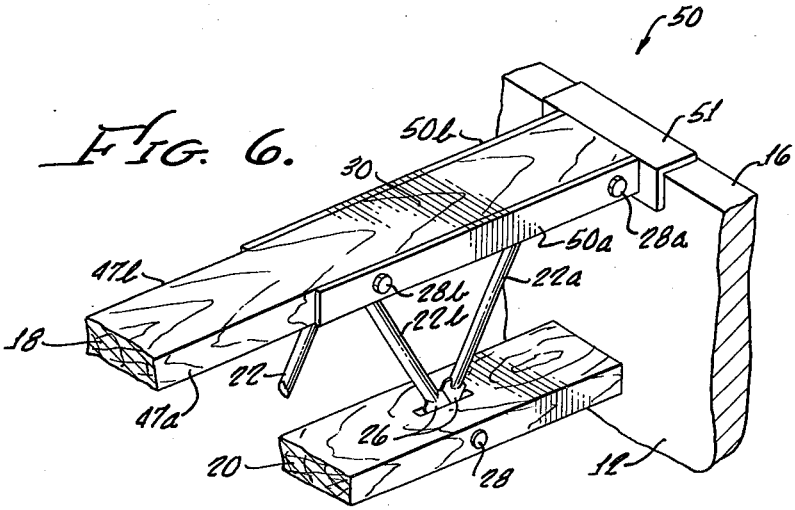
FIG. 6 is a perspective view of an alternative embodiment of the truss support connector showing the use of two exterior plates extending along the sides of the top chord member.

An alternative embodiment 50 of the truss support connector is shown in FIG. 6. Attached to an angle member 51 are a pair of strengthening members 50*a* and 50*b* extending along the vertical surfaces 47*a* and 47*b* of the top chord member 18. The pair of strengthening members 50*a* and 50*b* are connected to the top chord member by the insertion of the two pins 28*a* and 28*b* passing through the pair of strengthening members and the top chord member 18. Also receiving the pins 28*a* and 28*b* are the upper ends 24 of the web members 22*a* and 22*b* which are connected to the top chord member 18 by the pins 28*a* and 28*b*.

Figure 7:
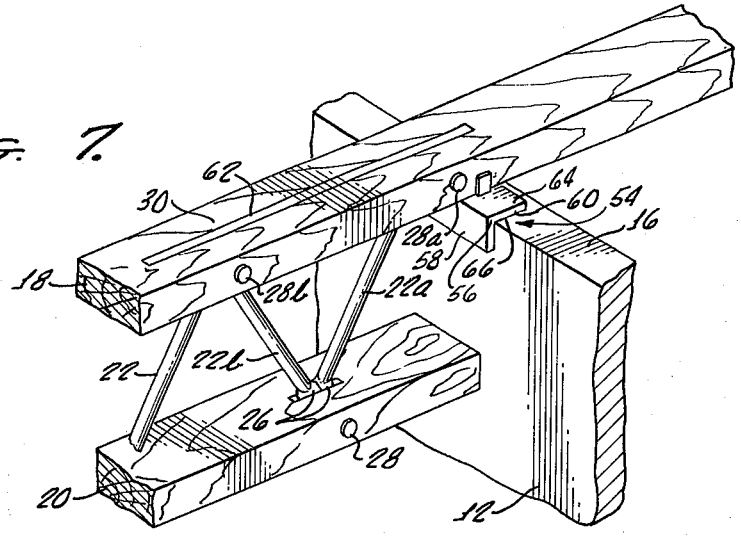
FIG. 7 is a perspective view of a further embodiment of the truss support connector showing the top chord member of the truss joist connection to the support with the angle member oriented so that the upper surface of the top chord member is above the upper surface of the support.

A further alternate truss support connector 54 as shown in FIG. 7 reflects an angle member 56 having a vertical leg 58 and a horizontal leg 60, which is connected to the strengthening member 62. The top chord member 18 rests on the top surface 64 of the horizontal leg 60 while the bottom surface 66 of the horizontal leg rests on the upper surface 16 of the supporting wall 12, resulting in the upper surface 30 of the top joist 18 being in a higher horizontal elevation than the upper surface 16 of the supporting wall 12. This allows the chord 18 to extend beyond the supporting wall 12. The strengthening member 62 is connected to the top joist member 18 by the pins 28*a* and 28*b* which also connect the upper ends 24 of the web members 22*a* to 22*b* to the top joist member 18. The strengthening member 62 as shown in FIG. 7 is a single plate as shown in FIGS. 2 and 5; however, the embodiment shown in FIG. 6 using the pair of strengthening members 50*a* and 50*b* could also be utilized.

Figure 8:
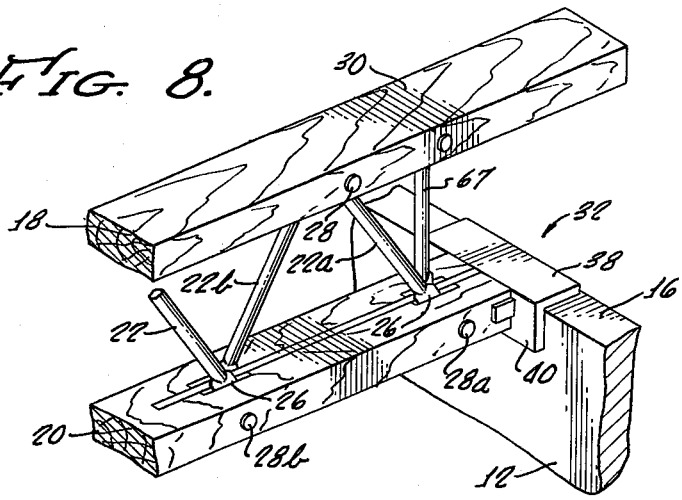
FIG. 8 is a perspective view of the preferred embodiment of the truss support connector attached to the bottom chord member of the truss joist for connection of the bottom chord member to the support.

Still another alternate arrangement is achieved by using the truss support connector 32 as shown in FIG. 8, attached to the bottom chord member 20 as opposed to the top chord member 18 as was shown in FIG. 2. The truss support connector shown in FIG. 8 could be either the embodiment reflected in FIGS. 2 and 5 with the single strengthening member 36 or the embodiment shown in FIG. 6 with the pair of strengthening members 50*a* and 50*b*. The attachment of the bottom chord member 20 to the support 12 with the truss support connector 32 results in the top chord member being placed at an elevation vertically above the top surface 16 of the support 12. An additional vertical web member 67 is necessary to provide adequate support for the top chord member 18.

Figure 9:
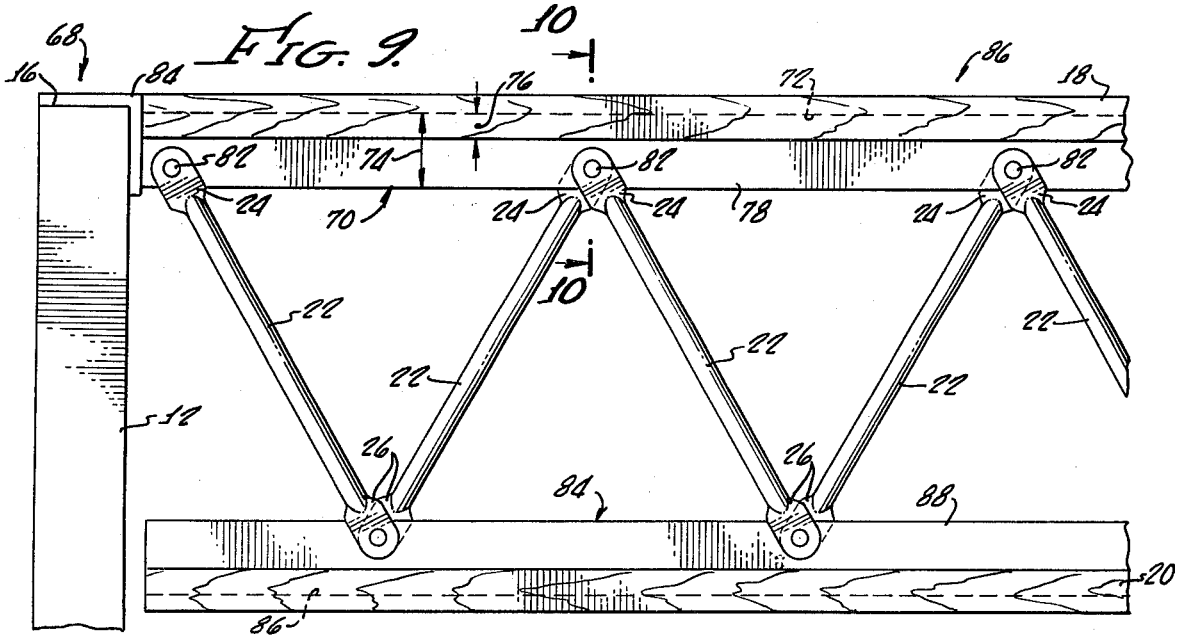
FIG. 9 is an elevation view of another embodiment of the truss support connector wherein part of the strengthening member of the truss connector is exposed to provide attachment points for the web members.

An additional embodiment 68 of the truss support connector invention is depicted in FIGS. 9 and 10 wherein the strengthening member 70 extends the entire length of the top chord 18. Located in the top chord member 18 is a continuous channel 72 for receipt of the strengthening member 70; however, the strengthening member has a greater depth 74 than the depth 76 of the channel 72, as shown in FIG. 10 resulting in an exposed portion 78 of the strengthening member 70 adjacent the chord member 18. The strengthening member is bonded within the channel 72 of the chord member 18 with a strong adhesive material 80, as shown in FIG. 10, so that the resulting weakness in the chord member 18 caused by the existence of the channel 72 is compensated by the adhesive insertion of the strengthening member 70.

The exposed portion 78 of the strengthening member 70 receives the upper ends 24 of the web members 22 which are connected to the exposed portion 78 by connecting pins 82. The strengthening member 70 is attached to the angle member 84 for placement of the truss joist 86 to the support 12. The bottom chord member 20 utilizes a web plate 84 along its entire length which is bonded in an open channel 86 similar to that in the top chord member 18. The web plate 84 has an exposed portion 88 for connection to the lower ends 26 of the web members 22.

A further possible embodiment 90 of the invention is shown as the truss support connector in FIG. 11. The strengthening member 92 of the truss support connector 90 is bonded within a channel 94 in the top chord member 18 in a similar manner as that shown in FIGS. 9 and 10. However, the strengthening member 92 which is attached to the angle member 96 extends to the second pin connection 82*b* while a series of web plates 98 are used to provide further connecting points along the top and bottom chord members 18 and 20 for the web members 22. The web plates 98 are connected to the respective chord members 18 and 20 by adhesive bonding within small channels 100, leaving an exposed portion 102 for connection to the web members 22. The use of separate web plates 98 rather than continuous members as in the embodiment of FIG. 9 reduces the necessary amount of plate material required while still providing adequate connecting points.

To establish a better surface on the web plates 98 for good bonding within the channels 100 a portion 104 of the web plates are perforated with holes 105 as in FIG. 12 or hatched 108 as in FIG. 13. This provides more surface area on which the adhesive material will adhere. In addition, not only the sides of the strengthening member 92 within the channel 94 in FIG. 11 but also the sides of the strengthening member 70 and continuous web plate 84 in FIG. 9 may be similarly perforated or hatched for better adhesion.

The truss support connectors reflected above in the various configurations are preferably made of some type of metallic substance, having greater strengths than wood. However, the material is not limited to metals, for any appropriate substance having greater strengths than wood would suffice. Although various combinations and arrangements have been shown and discussed above with respect to the various embodiments of the invention used with a truss, the extent of the possible combinations of the embodiments with various truss arrangements are not necessarily limited to those related in this discussion.

What is claimed is:

1. A truss arrangement for connecting a truss to a support surface, said arrangement comprising:

a top chord member;

a bottom chord member;

means for bearing substantially the entire load of one end of said truss, said means attaching only said top chord member to said support surface;

a plurality of horizontally spaced webs connecting said top chord member with said bottom chord member, each end of each of said webs horizontally spaced from said support surface and said attaching means;

means for connecting the ends of said webs to said top and bottom chord members;

each of said connecting means horizontally spaced from said support surface and said attaching means; and an elongate strengthening member, constructed of material having substantially greater shear strength than the material forming said top and bottom chord members, extended along the end of said top chord member, one end of said strengthening member attached to said means for attaching said top member to said support surface, said strengthening member reducing shear and moment forces in said upper chord member by extending from said bearing means to a point beyond two of said spaced means connecting said web ends to said top chord adjacent said support surface, said strengthening member terminating short of the center of said upper chord member.

2. A truss arrangement as defined in claim 1 wherein said strengthening member is connected directly to said connecting means connecting the upper ends of two of said spaced webs adjacent said support surface to said upper chord member.

3. A truss arrangement as defined in claim 1 wherein said means for bearing and said strengthening member are attached to one another in a configuration permitting said strengthening member to extend below said support surface, allowing the connection between said top chord member and said support surface to result in the upper surface of said top chord member being in the same horizontal plane as said support surface.

4. A truss arrangement as defined in claim 1 wherein said means for bearing comprises an L-shaped member having a horizontal leg attached to said support surface and a vertical leg attached to said strengthening member.

5. A truss arrangement as defined in claim 4 wherein said vertical leg of said L-shaped member extends below said horizontal leg, so that the connection between said top chord member and said L-shaped member results in the upper surface of said top chord member being in the same horizontal plane as said support surface.

6. A truss arrangement as defined in claim 1 wherein said means for bearing comprises an L-shaped member having a vertical leg and a horizontal leg attached to said support surface.

7. A truss arrangement as defined in claim 6 wherein said top chord rests on top of said horizontal leg and said strengthening member is attached to said horizontal leg.

8. A truss arrangement as defined in claim 1 wherein said means for connecting said webs to said top and bottom chord members comprises pin means through said top and bottom chord members and respective upper and lower ends of said spaced webs, two such pin members which pass through said top chord adjacent said support surface additionally passing through said elongate strengthening member.

9. A device for connecting a truss joist to a supporting wall and for removing excessive shear and moment forces from components of said joist, said truss joist having upper and lower horizontal wood chord members connected by horizontally spaced pins to horizontally spaced diagonal web members, comprising:

a steel strengthening member having one end connected to said supporting wall and the other end extended adjacent said upper chord member for attachment to two of said horizontally spaced pins, each of said two pins being horizontally spaced from said supporting wall, said steel strengthening member terminating short of the center of said upper chord member.

10. A device for connecting a truss joist to a supporting wall as defined in claim 9 and additionally comprising an angle member for connection of said one end of said strengthening member to said supporting wall.

11. A truss for connection to a support surface, said truss comprising:

a top chord;

a bottom chord;

a plurality of horizontally spaced web members connecting said top chord with said bottom chord;

a plurality of horizontally spaced means for attaching said web members to said top and bottom chord;

an angle member attached to said support surface; and a strengthening member, constructed of material having substantially higher shear strength than the material of said top and bottom chords, bearing substantially the entire load of one end of said truss, said member reducing shear and moment forces in said upper chord by having one end attached to said angle member and the other end connected to said top chord by a pair of said plural horizontally spaced attaching means, each of said pair being differently horizontally spaced from said support surface, said strengthening member having a length which is less than half the length of said upper chord.

12. A truss connector as defined in claim 11 wherein said means for attaching said web members to said top and bottom chords comprises pin means extending through said top and bottom cords and respective upper and lower ends of said spaced web members, a pair of said pin members passing through said strengthening member.

13. A truss connector as defined in claim 11 wherein said strengthening member comprises a single vertical metal plate extending through a slot in the end of said top chord.

14. A truss connector as defined in claim 11 wherein said strengthening member comprises a pair of vertical metal plates extending along the sides of said top chord.

15. A truss connector as defined in claim 11 wherein said angle member comprises an L-shaped member with a horizontal leg attached to said support surface and a vertical leg extending below said horizontal leg and attached to said strengthening member, so that the connection between said top chord and said angle member results in the upper surface of said top chord being in the same horizontal plane as said support surface.

16. A device for positioning a horizontal truss to a supporting wall, said truss of the type having a top and bottom horizontal chord connected by a plurality of horizontally spaced pins to a plurality of horizontally spaced web members, said device comprising:

an angle member bearing substantially the entire load of one end of said truss and attached to said supporting wall; and two strengthening members constructed of substantially greater shear strength material than the material used for said top and bottom chords and having lengths less than half the length of said top chord, said strengthening members attached at one end to said angle member and located adjacent said surfaces of said top chord, said strengthening members reducing shear and moment forces in said top chord by being connected directly at the other end to two of said horizontally spaced pins adjacent said supporting wall, each of said horizontally spaced pins being differently horizontally spaced from said angle member.

17. A device for attaching a truss to a supporting wall as defined in claim 16 wherein said strengthening members comprise a pair of metal plates.

18. A device for attaching a truss to a supporting wall as defined in claim 16 wherein said angle member comprises an L-shaped member with a horizontal leg attached to the top surface of said supporting wall and a vertical leg extending below said horizontal leg and attached to said strengthening members allowing the connection between said top chord and said angle member to result in the upper surface of said top chord being in the same horizontal plane as said top surface.

19. A truss arrangement for attachment to a supporting wall, said arrangement comprising:

a bottom chord;

a top chord constructed of a first material, said top chord having a slot at each of its ends;

a plurality of horizontally spaced web members for connecting said top chord to said bottom chord, each end of each of said web members being horizontally spaced from said supporting wall;

means for attaching said plurality of web members to said top and bottom chords, said attaching means horizontally spaced from said supporting wall;

an angle member positioned on said supporting wall; and a strengthening member constructed of a second material having a substantially higher shear strength than said first material with one end attached to said angle member and the other end terminating short of the center of said truss and connected within said slot of said top chord by two of said attaching means of two of said spaced web members differently horizontally spaced from said supporting wall.

20. A truss arrangement for attachment to a supporting wall as defined in claim 19 wherein said strengthening member comprises a vertical metal plate.

21. A truss arrangement for attachment to a supporting wall as defined in claim 19 wherein said angle member comprises an L-shaped member with a horizontal leg attached to the top surface of said supporting wall and a vertical leg extending below said horizontal leg and attached to said strengthening member permitting the connection between said top chord and said angle member to result in the upper surface of said top chord being in the same horizontal plane as said top surface.

22. A truss configuration for attaching a truss to a support surface, said configuration comprising:

a top wood chord with an open channel along the entire length of its lower surface;

a bottom wood chord with an open channel along the entire length of its upper surface;

steel strengthening members positioned within said open channel of said top and bottom chord, said strengthening members having an exposed portion not within said channel;

means for bonding said strengthening members within said open channels;

plurality of horizontally spaced web members connecting said strengthening members, each of said web members being horizontally spaced from said support surface;

an angle member having one end attached to one end of said stengthening member positioned within said top chord and the other end positioned on said support surface; and a plurality of pin connectors for attaching each end of said spaced web members to said exposed portion of said strengthening members, each of said pin connectors being horizontally spaced from said support surface.

23. A truss connector apparatus as defined in claim 22 wherein said means for bonding said strengthening members within said open channels comprises adhesive material.

24. A truss arrangement for connection to a support surface, said arrangement comprising:

a first wood chord having an open channel;

a second wood chord having an open channel;

a strengthening member located in said open channel of one of said first and second chords;

a plate member located in said open channel of the other of said first and second chords;

means for bonding a portion of said strengthening member and said plate member into said open channels of said first and second chords, said strengthening member and said plate member connected by web members;

a plurality of pin connectors each horizontally spaced from said support surface for attaching said web members to said strengthening member and said plate member; and an angle member with one end positioned on said support surface and the other end attached only to said strengthening member, said angle member and said strengthening member bearing substantially the entire load of one end of said truss.

* * * * *